US007220081B1

(12) United States Patent
Gantt, Jr.

(10) Patent No.: US 7,220,081 B1
(45) Date of Patent: May 22, 2007

(54) CONCENTRIC LOAD BEARING PIPING WITH LINER FOR FOUNDATION ANCHOR

(76) Inventor: William Allen Gantt, Jr., 1224 N. Brickyard Rd., Columbia, SC (US) 29223

( * ) Notice: Subject to any disclaimer, the term of this patent is extended or adjusted under 35 U.S.C. 154(b) by 0 days.

(21) Appl. No.: 11/406,106

(22) Filed: Apr. 18, 2006

(51) Int. Cl.
*E02D 5/08* (2006.01)

(52) U.S. Cl. ..... 405/230; 405/232; 405/251

(58) Field of Classification Search ..... 405/230, 405/231, 232, 249, 251, 253
See application file for complete search history.

(56) References Cited

U.S. PATENT DOCUMENTS

| | | | | |
|---|---|---|---|---|
| 4,339,899 | A | 7/1982 | Klenk et al. | |
| 4,695,203 | A * | 9/1987 | Gregory | 405/230 |
| 4,708,528 | A * | 11/1987 | Rippe | 405/230 |
| 4,925,345 | A * | 5/1990 | McCown et al. | 405/232 |
| 5,011,336 | A | 4/1991 | Hamilton et al. | |
| 5,120,163 | A | 6/1992 | Holdeman et al. | |
| 5,213,448 | A | 5/1993 | Seider et al. | |
| 5,234,287 | A * | 8/1993 | Rippe, Jr. | 405/230 |
| 5,575,593 | A * | 11/1996 | Raaf | 405/237 |
| 6,074,133 | A * | 6/2000 | Kelsey | 405/244 |
| 6,183,167 | B1 * | 2/2001 | Ruiz et al. | 405/251 |
| 6,514,012 | B2 * | 2/2003 | Gregory et al. | 405/230 |
| 6,641,332 | B1 * | 11/2003 | Alvarado | 405/232 |
| 7,090,437 | B2 * | 8/2006 | Pinkleton | 405/244 |
| 2003/0159839 | A1 * | 8/2003 | Perko | 172/100 |

* cited by examiner

*Primary Examiner*—Frederick L. Lagman
(74) *Attorney, Agent, or Firm*—J. Bennett Mullinax, LLC

(57) ABSTRACT

An apparatus and process for increasing the concentric bearing load capabilities of the length of liner is disclosed. Overlapping ends of vertically aligned pipe lengths are joined by a coupling which provides aligned throughholes through the respective pipe ends. A cylindrical liner having a length substantially equal to co-lengths of an individual pipe member is positioned such that a series of throughholes passing through an approximate mid-length portion of the liner are positioned opposite to and aligned with the pipe coupling throughholes. Fasteners are then used to secure the two vertically aligned overlapping pipe ends to the interior liner pipe.

5 Claims, 5 Drawing Sheets

CONCENTRIC LOAD BEARING PIPING WITH LINER FOR FOUNDATION ANCHOR

FIELD OF THE INVENTION

This invention is directed towards an apparatus and process for increasing the concentric load bearing capabilities for a building foundation support assembly. Various foundation support footings and anchoring systems are known to be used where a bracket, secured to a building foundation, is further supported by a helical anchor which is driven a desired depth below the foundation of the building. The helical anchor is secured to the foundation bracket to provide support to the foundation from settling or uplifting forces. The present invention relates generally to an apparatus and process for improving the concentric load capabilities for each respective anchoring apparatus used with a building.

BACKGROUND OF THE INVENTION

This invention relates generally to foundation support brackets. Buildings often experience foundation settling attributable to loose or sandy soil present around the foundation, overly moist soil, and/or improper construction of the foundation.

It is known in the art to use embedded earth anchors and brackets as a means of supporting foundations. Typically, a screw anchor is positioned beneath a foundation using a torque drive. Respective anchors are positioned at a depth sufficient to support the load of the building structure so as to avoid further settlement of either the screw anchors or the foundation.

The number of screw anchors and foundation supports attached thereto generally correlate to the amount of force needed to support the foundation. Underpinning a foundation using foundation anchors and support brackets is costly in terms of the time and materials needed to install the requisite number of anchors and attached foundation brackets. Any ability to increase the load capabilities of the foundation support apparatus can result in substantial savings of materials and labor by reducing the number of foundation supports needed to shore the foundation. Heretofore, screw anchors were driven by a torque into below ground positions using lengths of square tubing or cylindrical pipe as connectors. As the helical screw is driven further into the foundation subsoil, lengths of tubing or pipe are attached via overlapping ends until the desired depth is obtained. The concentric load bearing capabilities of the tubing or pipe are often the determining factor in the amount of load bearing capability for any single helical anchor and attached bracket. Accordingly, there remains room for improvement and variation within the art in terms of an apparatus and process for increasing the concentric load bearing capabilities of a foundation anchoring system.

SUMMARY OF THE INVENTION

It is one aspect of at least one of the present embodiments to provide for tubular connectors having a series of inner liner sleeves which are positioned between a screw anchor embedded in the soil beneath a building and a foundation bracket where the tubular connectors have improved concentric load capabilities in comparison to an unlined tubular connector.

It is a further aspect of at least one embodiment of this invention to provide for a liner for a tubular connector in which the liner defines along an approximate mid-point a plurality of apertures adapted for engagement with a similar pair of aligned apertures defined in the outer walls of the tubular connector.

It is a further aspect of at least one embodiment of the this invention to provide for a process of securing a foundation bracket to a helical anchor comprising the steps of inserting a helical anchor adjacent a foundation of a building; installing a first push pipe extension to the helical anchor; inserting into an interior of the first push pipe a cylindrical liner which extends substantially about one half a length of the liner into the interior of the first push pipe, the cylindrical liner having a terminal one half length extending from a terminus of the first push pipe; inserting over the terminal length of the liner a second push pipe, the first push pipe and the second push pipe having overlapping ends and having disposed thereon the liner extending therebetween, the first push pipe, the second push pine, and the liner being bolted together through a series of aligned apertures; alternating attaching additional pieces of the push pipe and the liner until a desired depth of the helical anchor is obtained; securing the uppermost end of the liner reinforced push pipe to the foundation bracket; wherein the liner reinforced push pipe has an increased concentric load bearing capability than the push pipe without the liner.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1A:
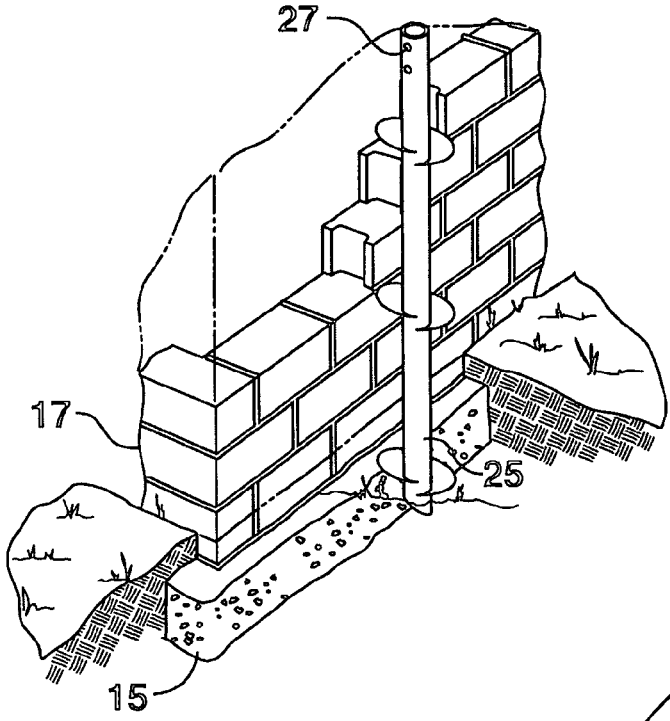
FIGS. 1A through 1C illustrate a helical anchor being inserted into the ground adjacent to a building.
Figure 1B:
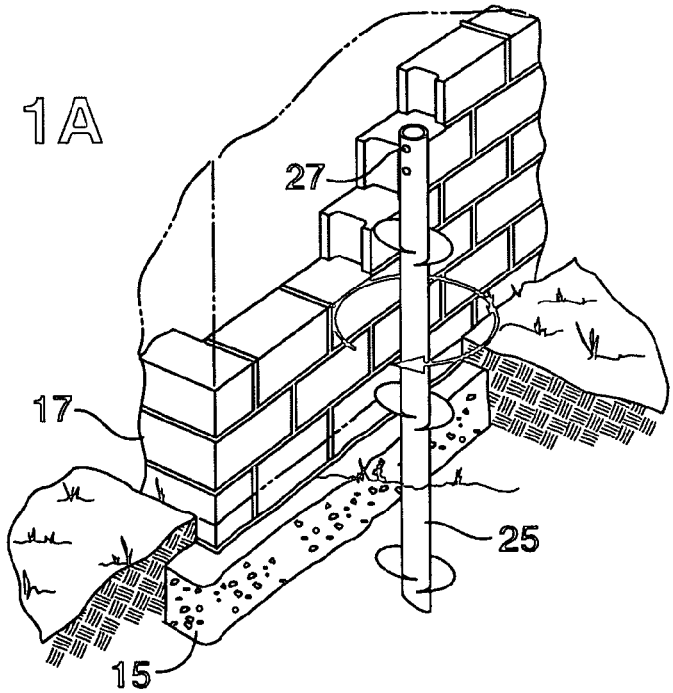
Figure 1C:
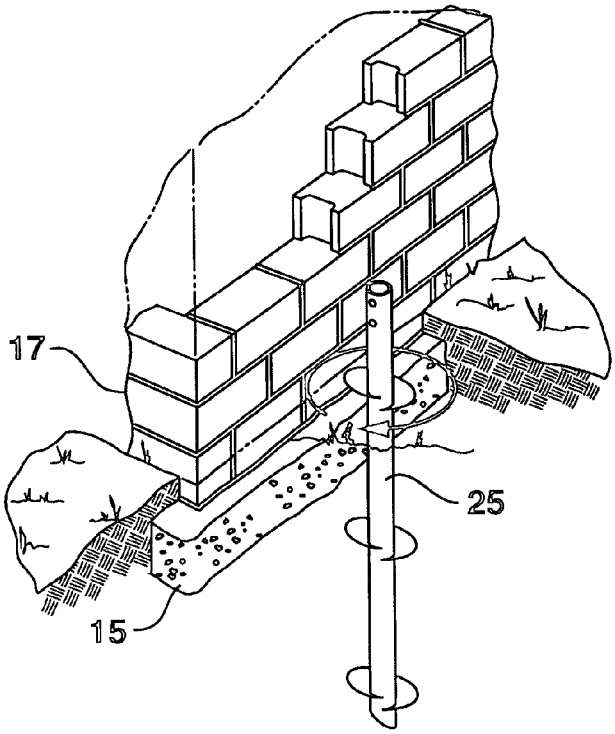

As seen in reference to FIGS. 1A, 1B, and 1F, a building 17 having a foundation 15 which, as illustrated here, may be below the surface of the soil, is illustrated. A helical anchor 25 is inserted through rotation to a desired depth below the foundation of the building. The actual depth needed varies depending upon the load bearing requirements of the foundation, the nature of the subsurface soil, and other conditions which are well understood and known by those having ordinary skill in the art. The helical anchor 25 is inserted to the desired depth by the addition of tubular push pipe extensions 20 and may be added sequentially as needed to secure helical anchor 25 to a desired depth below the surface grade.

Figure 1D:
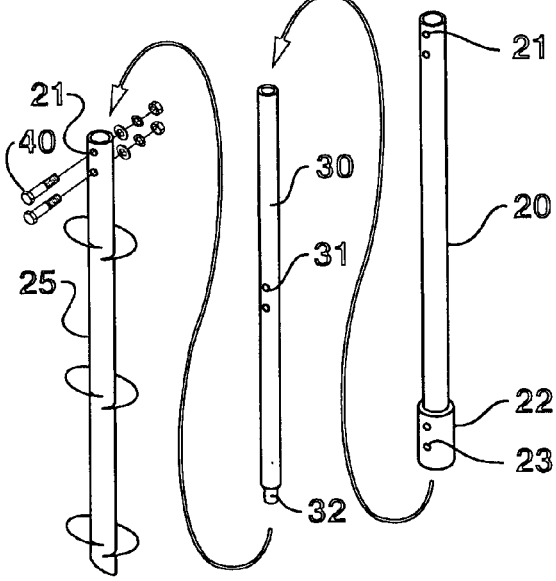
FIGS. 1D and 1E illustrate the components in a respective unassembled and assembled arrangement.
Figure 1E:
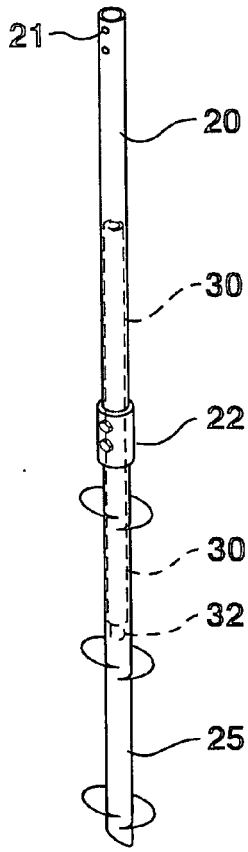
Figure 1F:
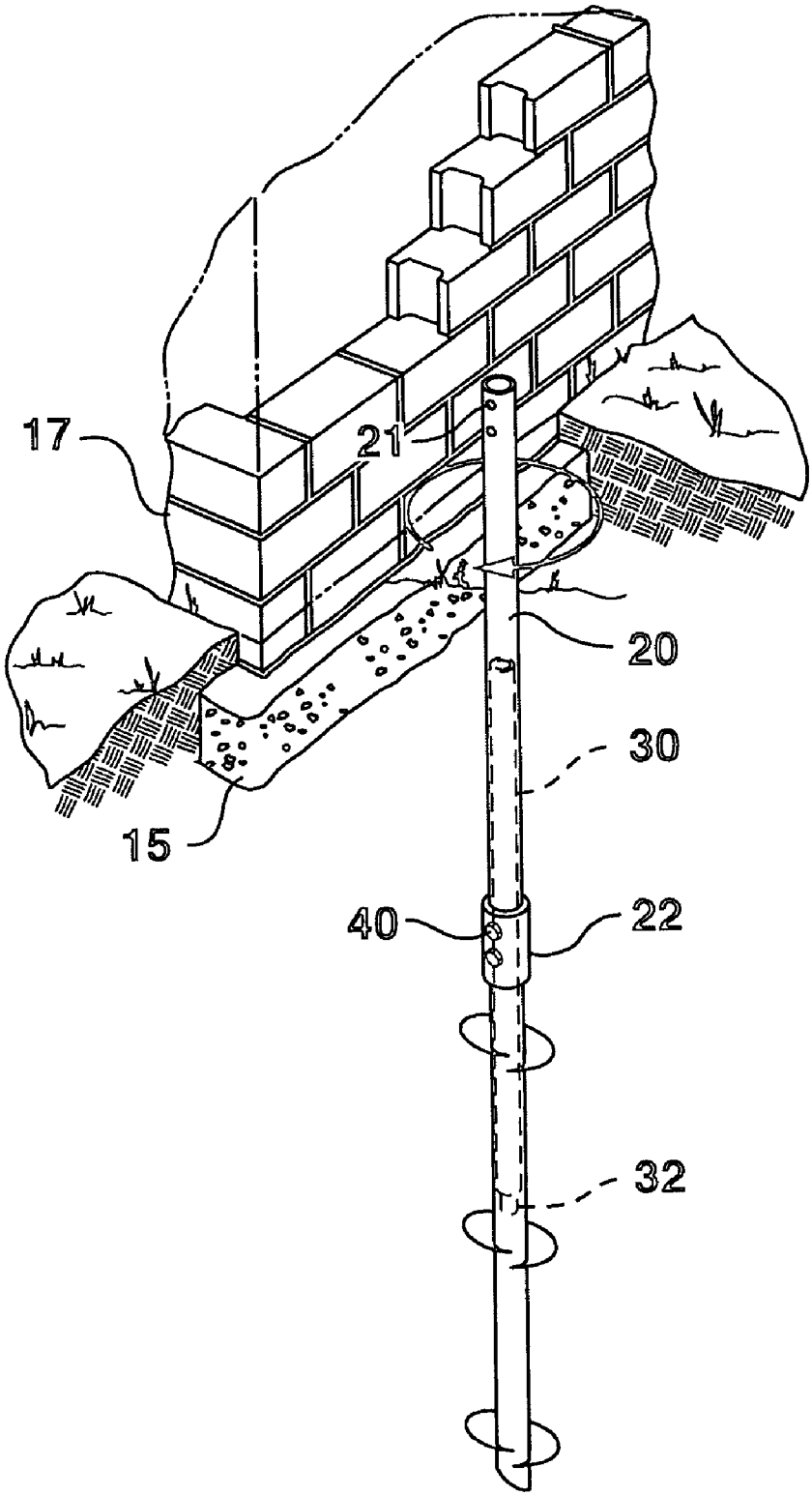
FIG. 1F illustrates the assembled components and partial phantom in relation to a building foundation.

As seen in reference to FIG. 1F, an individual length of push pipe 20 defines a large diameter coupling along one end which is designed to interengage through a plurality of apertures corresponding to holes 21 along one of either the helical anchor 25 or a previously installed length of push pipe 20. As additionally seen in reference to FIG. 1B and FIG. 1F, a liner 30 may be inserted within the bore of push pipe 20 and any adjacent push pipe 20 and/or helical anchor 25. As illustrated, liner 30 defines a plurality of spaced apertures 31 substantially midway along the liner and which traverse the liner on opposite sides. Bolts 40 and corresponding washers and nuts are then used to secure the air liner 30 through apertures 31 while also securing the outer push pipe 20 through apertures 23 defined on the coupling 22.

In the final arrangement as seen in reference to FIG. 1E, the inner liner 30 traverses approximately half the distance of the adjacent upper and lower portions of the surrounding push pipe and/or helical anchor. Additional interlocking segments of liner 30 and push pipe 20 may be added as needed to extend the helical anchor to the desired depth.

Figure 2:
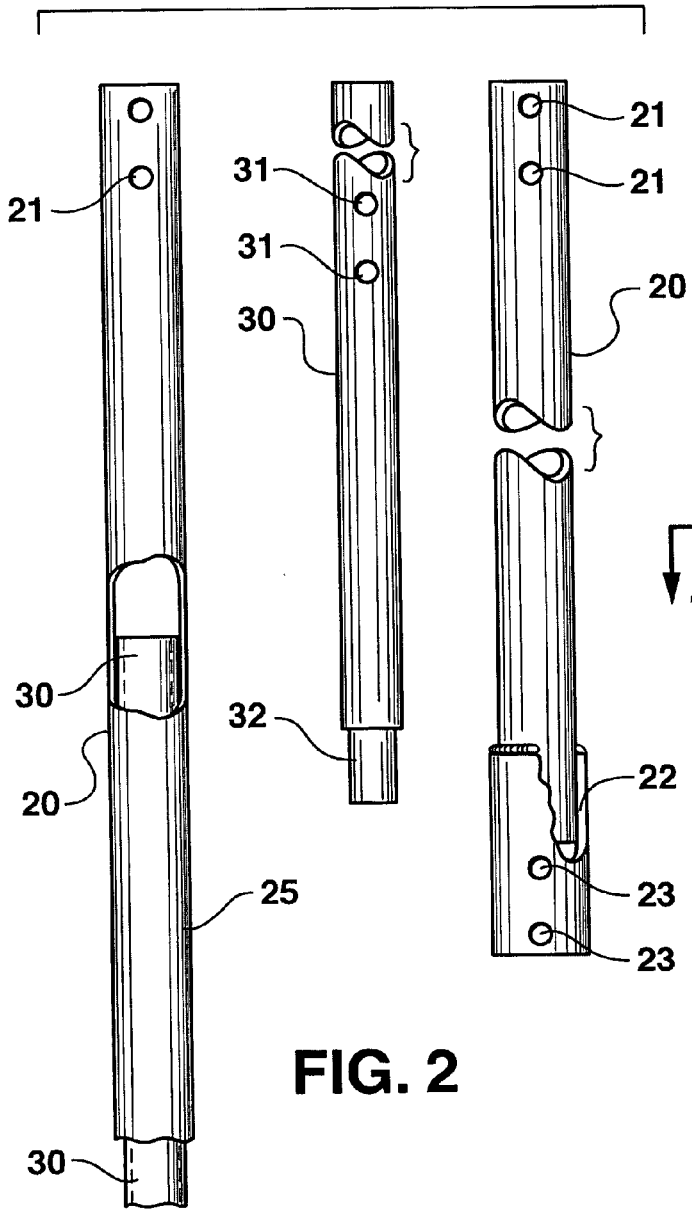
FIG. 2 is a perspective view of the components of extension tubes and the extension tube liners which may be used to connect a helical anchor to a foundation bracket.

As seen in reference to FIG. 2, liner 30 may be inserted into an uppermost length of push pipe 20 wherein apertures 21 of push pipe 20 will align with apertures 31 of liner 30. Nipple 32 of liner 30 is designed to interengage with the larger diameter of the adjacent liner 30 when inserted into push pipe 20. Prior to securing the push pipe 20 to the liner 30, an additional length of push pipe 20 is inserted over the liner such that the apertures 23 of coupling 22 also are in alignment with the corresponding apertures 21 of the overlapping portion of the adjacent push pipe 20 and the apertures 31 of liner 30. Bolts 40 along with associated washers and threaded nuts may be used to secure the interengaged pieces.

Figure 3:
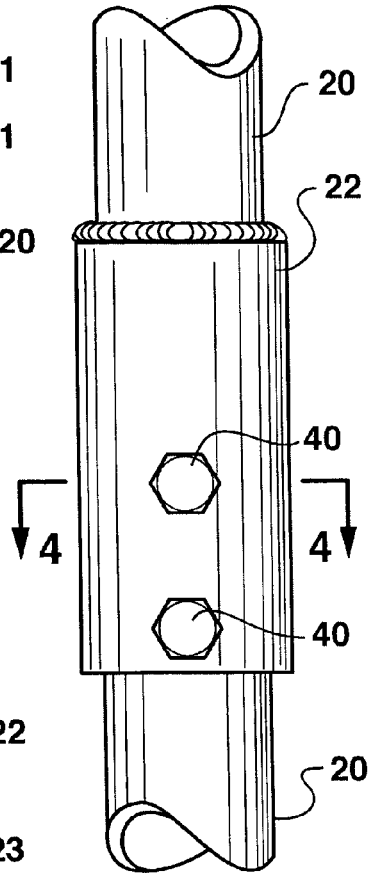
FIG. 3 is an enlarged view of one section of the load bearing pipe attached to a lower segment of a load bearing pipe.
Figure 4:
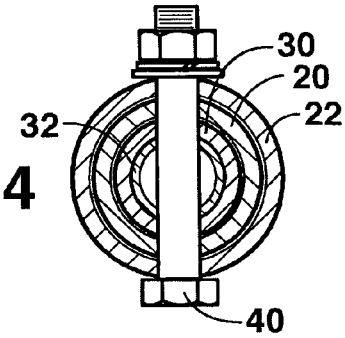
FIG. 4 is a cross section through FIG. 3 illustrating a final assembly of a load bearing pipe having a reinforcement liner present within the pipe.

In FIG. 4, a cross section through the assembled push pipe 20 having liner 30 installed therein is illustrated, the cross section take through a coupling 22 as seen in reference to FIG. 3.

It has been found beneficial to design the length of liner to be slightly less than the individual length of push pipe to account for minor variations in manufacturing tolerances. In this manner, the liners will be assured of adequate play so that the liner apertures 31 may be properly lined up with respect to apertures 21 of an outermost length of push pipe 20. Additional overlap occurs with an upper portion of push pipe 20 having coupling 22 and corresponding apertures 23 placed in alignment as well.

Figure 1G:
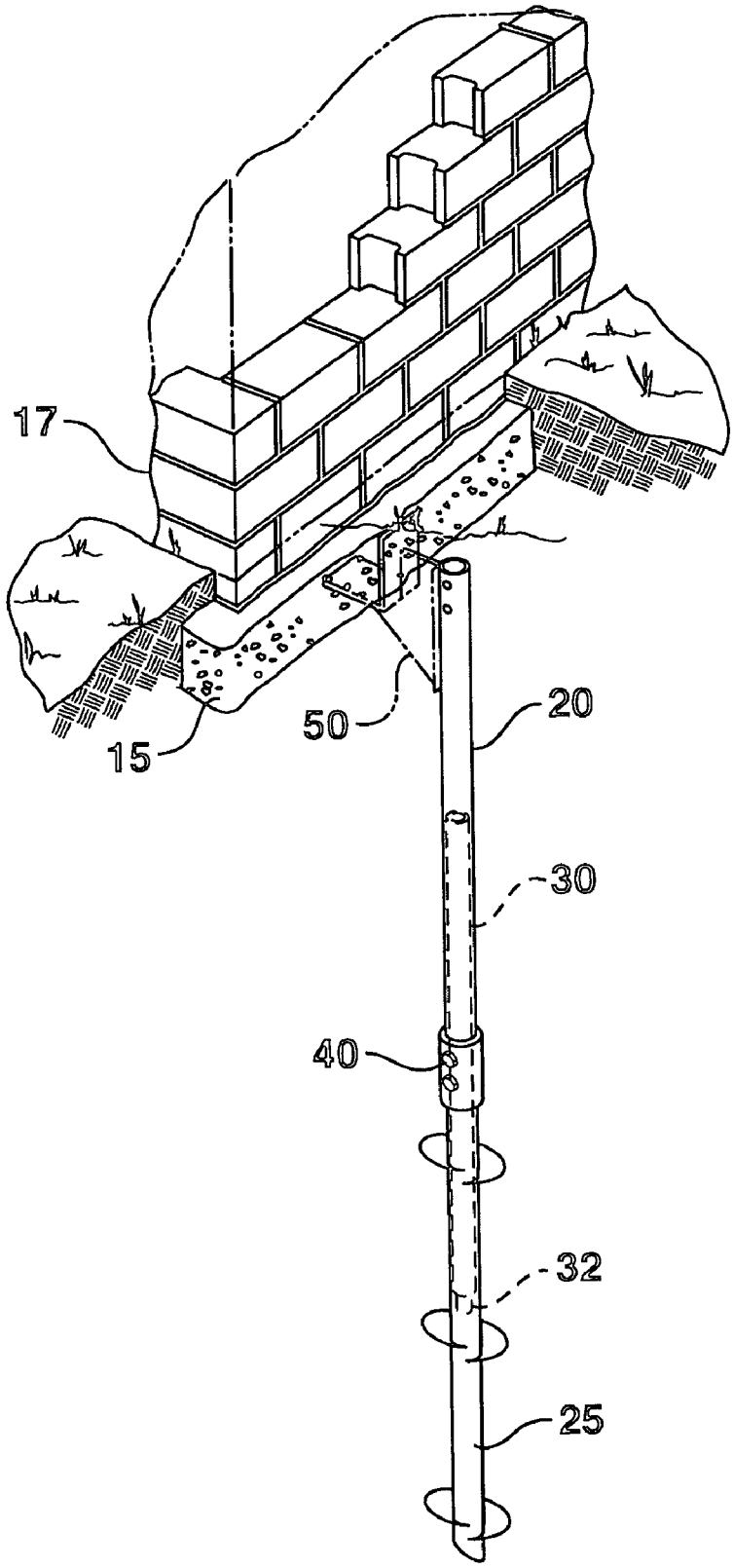
FIG. 1G illustrates a helical anchor attached tubing as seen anchored to a foundation bracket.

The alternating segments of push pipe with liners may be assembled to any desired depth and then manually at a desired height so as to secure the anchored push pipe to a foundation bracket 50 as seen in reference to FIG. 1G. It is readily understood by one having ordinary skill in the art that the liner reinforced push pipe as described herein may be used with any number of conventional foundation brackets as are known in the art. Representative brackets include foundation brackets marketed by the assignee such as the Model 99110 sold under the Driverite Piering System™ brand as well as brackets described in U.S. Pat. No. 5,213,448 and U.S. Pat. No. 5,120,163, the teachings and specifications of which are incorporated herein by reference.

The push pipe 20 and liners 30 described herein may be made of conventional metal pipe. It has been found that a 3½" diameter push pipe having a 4½" coupling 22 may be used in combination with a liner 20 having a 2⅞" diameter and end nipple 32 having a reduced diameter of 2⅜". The combination push pipe and liner as described herein, has been found to have increased concentric load bearing capabilities in comparison to the unlined push pipe. In addition to increased concentric load bearing capabilities, significant improvements are noted in the ability of the flexure plastic moment capabilities which increases from 12,100 lb-ft to 19,100 lb-ft when using a concentric liner in the configurations as described above. Additionally, the increased shaft strength also allows for an increase of installation torque which increases from an unlined value of 10,000 lb-ft to 12,000 lb-ft when a liner 30 is present within the push pipe 20. Evaluations per ASIC allowable stress design demonstrates that the maximum allowable bending movement upon an unlined sample pipe of 5,860 lb-ft may be increased to 8,650 lb-ft when using a liner as described herein. Similarly, per ASIC criteria, the load and resistance factor design for flexural strength increases from 10,900 lb-ft to 17,200 lb-ft where a liner is present.

For the purposes of illustration in FIGS. 1D through 1F, the liner 30 is seen extending into the interior portion of the helical anchor 25. It is understood that the insertion is not always required and, depending upon the structure of the helical anchor, may not be possible. However, the similar, overlapping segment construction seen in FIGS. 1D through 1F may be used in which overlapping segments of push pipe 20 are reinforced at the overlapping joints at coupling 22 by a liner secured to the coupling joint along a mid-length portion of the liner. The liner 30 and push pipe 20 have substantially equal lengths such that the alternating arrangement of liners and push pipes are such that each connection between adjacent push pipe lengths 20 are reinforced by a length of liner 30. By securing liner 30 along a mid-point to the overlapping ends of the adjacent push pipe pieces 20, the liner provides greater reinforcement than liners which do not substantially traverse half length segments of connecting lengths of push pipe 20.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

What is claimed is:

1. A process of securing a foundation bracket to a helical anchor comprising the steps of:

inserting a helical anchor adjacent a foundation of a building;

installing a first push pipe extension to said helical anchor;

inserting into an interior of said first push pipe a first end of a cylindrical liner which extends about one half a length of said liner into the interior of said first push pipe, said cylindrical liner having a terminal one half length defining said second end extending from a terminus of said first push pipe;

inserting over said terminal length of said liner a second push pipe, said first push pipe and a first end of said second push pipe having overlapping ends and having disposed therein said liner extending therebetween, said first push pipe, said second push pipe, and said liner being bolted together through a series of aligned apertures;

alternating attaching additional pieces of said push pipe and said liner until a desired depth of said helical anchor is obtained;

securing the uppermost end of said liner reinforced push pipe to said foundation bracket;

wherein said liner reinforced push pipe has an increased concentric load bearing capability than said push pipe without said liner.

2. The process according to claim 1 wherein said first end of said cylindrical liner is secured to said extension of said helical anchor.

3. The process according to claim 1 wherein each of said alternating additional pieces of said liner has a length less than a length of each alternating said push pipe.

4. A process of securing a foundation bracket to a helical anchor comprising the steps of:

inserting a helical anchor adjacent a foundation of a building;

installing a first push pipe extension to said helical anchor;

inserting into an interior of said first push pipe a first end of a cylindrical liner which extends about one half a length of said liner into the interior of said first push pipe, said first end of said cylindrical liner being attached to at least one of said helical anchor or said first push pipe extension, said cylindrical liner having a terminal one half length defining said second end extending from a terminus of said first push pipe;

inserting over said terminal length of said liner a second push pipe, said first push pipe and a first end of said second push pipe having overlapping ends and having disposed therein said liner extending therebetween, said first push pipe, said second push pipe, and said liner being bolted together through a series of aligned apertures;

alternating attaching additional pieces of said push pipe and said liner until a desired depth of said helical anchor is obtained;

securing the uppermost end of said liner reinforced push pipe to said foundation bracket;

wherein said liner reinforced push pipe has an increased concentric load bearing capability than said push pipe without said liner.

5. The process according to claim 4 wherein each of said alternating additional pieces of said liner has a length less than a length of each alternating said push pipe.

* * * * *